US005850801A

United States Patent [19]

Grimmig

[11] Patent Number: 5,850,801

[45] Date of Patent: Dec. 22, 1998

[54] PUSHING UNIT

[75] Inventor: Dieter Grimmig, Dresden, Germany

[73] Assignees: Hans Grimmig GmbH, Dresden; Schiffswerft Oberelbe GmbH, Bad Schandau, both of Germany

[21] Appl. No.: 693,110

[22] PCT Filed: Feb. 15, 1995

[86] PCT No.: PCT/DE95/00187

§ 371 Date: Aug. 19, 1996

§ 102(e) Date: Aug. 19, 1996

[87] PCT Pub. No.: WO95/22485

PCT Pub. Date: Aug. 24, 1995

[30] Foreign Application Priority Data

Feb. 18, 1994 [DE] Germany ..... 44 05 177.8

[51] Int. Cl.[6] ..... B63B 21/56

[52] U.S. Cl. ..... 114/242; 440/90; 114/138

[58] Field of Search ..... 114/26, 31, 151, 114/242, 246, 248, 249, 251, 63, 58; 440/90–92

[56] References Cited

U.S. PATENT DOCUMENTS

| | | | |
|---|---|---|---|
| 25,429 | 9/1859 | Lytle | 114/246 |
| 254,878 | 3/1882 | Little | 114/246 |
| 364,638 | 6/1887 | Forward | 114/63 |
| 1,526,327 | 2/1925 | Edwards . | |
| 1,675,606 | 7/1928 | Henry . | |
| 2,346,959 | 4/1944 | Ellinghouse | 440/90 |
| 2,486,275 | 10/1949 | Grinwald | 440/90 |
| 2,699,135 | 1/1955 | Steiner | 114/26 |
| 2,699,138 | 1/1955 | Dyer | 114/151 |
| 2,987,027 | 6/1961 | Wanzer | 440/54 |
| 3,125,059 | 3/1964 | Verneaux et al. | 114/246 |
| 3,170,437 | 2/1965 | Kilmer | 440/91 |
| 4,004,544 | 1/1977 | Moore | 440/90 |
| 4,364,322 | 12/1982 | Van Roon | 114/71 |
| 4,928,613 | 5/1990 | Rudolf | 114/246 |

FOREIGN PATENT DOCUMENTS

| | | |
|---|---|---|
| 0 038 545 | 10/1981 | European Pat. Off. . |
| 94 02 675 | 6/1994 | Germany . |
| WO 87/02325 | 4/1987 | WIPO . |

*Primary Examiner*—Ed L. Swinehart
*Attorney, Agent, or Firm*—Bell, Seltzer Intellectual Property Law Group of Alston & Bird LLP

[57] ABSTRACT

A water craft assembly comprising a towboat (1) and a barge (2) pushed and steered by the towboat (1) and which is designed and constructed for use in shallow water with an optimal cargo-carrying capacity, and wherein the towboat includes a paddle wheel drive mounted in its stern.

19 Claims, 4 Drawing Sheets

PUSHING UNIT

BACKGROUND OF THE INVENTION

The invention relates to an assembly comprising a towboat and a barge or pram pushed and steered by the towboat, for transporting cargo on a waterway.

The push-towing operation of barges is a special form of inland waterways navigation, which generally includes the combination of several unmanned barges, also called lighters or prams, which are more or less rigidly tied together to form a tow and are pushed and steered by a towboat. Commonly known towboats have in general the compact shape of a pontoon with a squared bow and a forwardly mounted push shoulder serving as a support for the tow. The barges are normally simple steel structures of sectional construction in pontoon shape and have in general a vertical surface at one end. Their number and arrangement in front or on the side of the towboat depends on the particular channel conditions. The cargo carrying capacity of a commonly known, individual barge is from a few hundred to three thousand tons. Other types of tows consist of a motorboat and a barge rigidly tied thereto, which is simply described as a coupled or integrated tow. The economic advantages of the tow include a small crew, low cost of construction of the barges with a high load capacity, a far-reaching standardization of great flexibility in making up the tows, in particular, the independence of the motorboats during loading and unloading of the cargo carriers.

Numerous rivers can be navigated by cargo ships only to a limited extent, since for lack of dams, their water level is extremely low, at least over certain distances, and especially in summer, namely during the best construction season. Among the problematic rivers is the Elbe River, which could be an ideal waterway for transporting building materials, in particular sand and gravel, were its navigability adequately guaranteed. Thus, it would be possible to use, for example, the Elbe River and the waterways of the Brandenburg March, i.e., a waterway to Berlin, for transporting materials that otherwise are transported only by trucks. However, this would require the use of a special type of cargo ships, namely such, which have an optimal load capacity in extremely low waters.

It is therefore the object of the present invention to provide a cargo transporting water craft assembly of the above-described type, which is suitable for use in low water with an optimal load capacity.

SUMMARY OF THE INVENTION

The above and other objects and advantages of the present invention are achieved by the provision of a cargo transport assembly for transporting cargo on a shallow waterway, and which comprises a towboat including a paddle wheel drive, and at least one barge operatively connected to the towboat. The barge includes a barge drive, with the barge drive being vertically adjustable and rotatable by 360°, and a drive control is located on the towboat for controlling the barge drive.

In accordance with the invention, it has first been recognized, that an integrated tow is especially suitable for moving loose bulk cargoes, such as, for example, gravel, sand, stone chippings, coal, etc. in low water. Next, it has been recognized that integrated tows must have only a small depth of immersion even with an optimal load capacity. An adequate or powerful drive of a high efficiency is possible in a further manner in accordance with the invention, even with a small depth of immersion, when the drive associated to the stern of the towboat is a paddle wheel. On the one hand, such a paddle wheel drive provides for the necessary thrust and, on the other hand, it permits the small depth of immersion that is required for navigation in low water.

As regards the paddle wheel drive of the present invention, a simplest construction may be configured such that the paddle wheel drive comprises a paddle wheel or, preferably, two paddle wheels mounted on a common driving shaft. However, to ensure an adequate maneuverability in the smallest space, it will be of advantage, when the paddle wheel drive comprises two paddle wheels mounted on two axially aligned shafts, which may be driven synchronously or at different rotational speeds and, if need be, in opposite directions of rotation. Paddle wheels being driven in opposite directions of rotation would permit the towboat to turn almost on the spot. Synchronously rotating paddle wheels will permit the direction or steering of the towboat to be corrected without difficulty.

As a result of the small, maximally safe depth of immersion in low water, it could be especially advantageous to make the driving shaft or shafts vertically adjustable for compensating for the different depths of immersion as a result of a full tank on the one hand and an empty tank on the other. This would permit the paddle wheel or paddle wheels to be immersed always optimally and, thus, adequately, regardless of the filling in the fuel tank. A disadvantage of such a construction includes the related extra expenses and, thus, an increased cost of manufacture. Moreover, this feature will also increase the weight and the depth of immersion.

The paddle wheels should have a diameter of at least 3.5 m, which may ultimately be derived from the overall dimensions of the towboat. Likewise, it would be advantageous, if the two paddle wheels together had the width of the towboat, so that the effective surface of the paddles forming the paddle wheels is maximal for attaining the required thrust.

The paddles of the paddle wheel as well as the other components of the paddle wheel could be made of wood. Within the scope of a weight reduction that is always attempted, both the paddles and the other components of the paddle wheel could be made of aluminum. Likewise possible is a mixed construction. Furthermore, preferably when the paddle wheel bearings are rigidly mounted, it would be advantageous, if a vertically downward extending paddle, i.e. in each instance the lowest paddle of the paddle wheel, barely immersed with its upper edge below the water surface in the case of a full tank, and projected by a few centimeters from a motionless water surface, when the tank is empty. Also this information is obvious from the other overall dimensions of the towboat.

With regard to the towboat drive, it will be advantageous, at least in the case of two paddle wheels, each of which rotates independently of the other, when two synchronously controllable diesel engines are provided. These diesel engines may drive the paddle wheels each individually. Thus, it will always be possible to also compare the two engines and, thus, to examine the efficiency, whereby it will become simple to detect defects in the drive by way of comparison.

Preferably, the required diesel fuel could be stored in tanks made of polyethylene. A tank of this type would be accommodated in the region of the center of gravity of the towboat. When providing several tanks, same could be arranged in the towboat, fore and aft, approximately along a diagonal line through the center of gravity of the boat, thereby providing a further stabilization of the towboat. The same applies to the arrangement of the engines. The tank or the tanks should hold about 30,000 liters of diesel fuel.

The power transmission from the engines to the paddle wheels advantageously may comprise a hydraulic system, since the components required for a hydraulic power transmission have a relatively low weight. With respect to such a hydraulic power transmission, reference may be made to the relevant state of the art, in particular the engineering of construction equipment, inasmuch as same is general knowledge to a person having ordinary skill in the art. Furthermore, it is essential that the rotational speed of the engines or paddle wheels be infinitely variable. This is feasible with the simplest means within the scope of a hydraulic power transmission between the motors and the paddle wheels by means of variable delivery pressure pumps.

The hull of the towboat is constructed in a very advantageous manner as a pontoon. This pontoon could be provided with closed and open transverse bulkheads as well as diagonal struts for stabilization, which may also be perforated for reducing the weight. Closed transverse bulkheads are required at least in part for safety reasons in the event of leakage, so that penetrated water is unable to cause a shift in the center of gravity, which could result in capsizing.

As regards the attempted continuous navigation on the Elbe River, even in extreme low water, the hull should have an immersion depth from 60 cm to 65 cm. Furthermore, the towboat should be designed such as not to exceed—with any component—a maximum immersion depth of about 90 cm with a full tank or tanks.

To promote the incident flow against the paddle wheels, the ship bottom preferably slopes toward the paddle wheels at an angle of less than 30°. This ensures a laminar flow toward the paddle wheels, i.e., energy-absorbing turbulences are avoided.

Typically, the towboat is rudderless. The steering of the towboat and, thus, of the entire tow occurs as a result of the different rotational speeds, or even different directions of rotation of the two independently operable paddle wheels. However, a rudder may be provided to assist in maneuvering. This rudder could be arranged in the towboat, preferably in the region of the sloping ship bottom in front of the paddle wheels.

To stabilize a straight-ahead travel of both the entire assembly and of the towboat alone, the hull could advantageously be provided with keels extending as projections from both side walls downward, preferably by 25 cm. While these keels increase the total weight of the towboat, they also contribute to a considerable stabilization of the straight-ahead travel.

Furthermore, the hull should laterally be closed in the region of the paddle wheels, so as to avoid an escape of the water and, thus, a decrease in efficiency.

In a further advantageous manner, the towboat is provided with a vertically adjustable pilot bridge, which permits a passage even under low bridges. More specifically, the pilot bridge could be arranged on a lifting mechanism constructed in the fashion of a scissor-type folding table. Likewise possible for use as a lifting mechanism is a cylinder-piston arrangement with a corresponding guideway. In any event, the pilot bridge is arranged substantially at the forward end of the hull, so as to provide also a good overview of the barge. Furthermore, the towboat could be provided with a superstructure for use as living quarters and engine room, which is arranged substantially in the center of the hull. Such a superstructure is absolutely necessary for longer lasting travels.

The following description relates to advantageous configurations of the barge. Like the hull of the towboat, the barge is constructed as a pontoon, but has advantageously a streamlined bow configuration. With respect to providing transverse bulkheads and diagonal struts, the description of the towboat is herewith incorporated by reference, so that a more detailed description is not needed.

Due to its relatively high load capacity with cargo and with a small depth of immersion, the barge in particular has naturally only a minimal depth of immersion in its unloaded state, thereby exhibiting a great tendency to drifting. A strong side wind, or already a higher speed during a downstream travel will endanger the maneuverability of the assembly. Consequently, the barge is preferably provided with at least one, vertically actuatable or even tiltable projection or skeg. For a better stabilization, at least two lateral skegs are provided and, within the scope of a particularly preferred embodiment, two pairs of lateral skegs are arranged in the forward region and one pair of skegs in the rearward region. These skegs can be operated, i.e., lowered and raised, mechanically and/or hydraulically or pneumatically.

To further improve the maneuverability of the assembly, the barge is provided, preferably at its bow, with a drive that is controllable from the towboat. In a further advantageous manner, this drive is vertically adjustable and, if need be, rotatable by 360°. More specifically, the drive could be a Schottel pump jet drive. The arrangement of this drive would have the advantage that the barge is independently maneuverable to a limited extent, which brings an enormous advantage, in particular in a port and in the field of gravel dredging. Thus, the barge is self-propelled, which is desirable with respect to independent docking and takeoff operations. The combination of the skegs and the additional drive ensure the maneuverability of the tow, in particular when travelling without cargo. In this instance, when viewed alone, the barge itself is maneuverable to a limited extent. For this purpose, at least a temporarily separate supply of energy to the drive may be provided, so that, even when the barge is separated from the towboat, energy may be supplied to the drive of the barge.

As previously indicated, the barge is constructed as a pontoon. Accordingly, the barge has no internal loading surface. Instead, it has a closed surface which has the profile of a saddle roof with a transverse inclination of 2°. To be able to pile sand or gravel safely on the loading surface, the loading surface is defined by a peripheral boundary. The lateral boundary of the loading surface could have a height of 0.3 m. The boundary at each end of the loading surface could be designed as a wall for countermoving the cargo, the height of the boundary walls being increased to 0.7 m. Such a configuration or dimensioning of the loading surface boundary serves, among other things, the purpose of unloading and mechanically cleaning with a so-called bobcat, the rear or the front boundary wall serving to countermove the cargo. The lateral boundary of the loading surface may also be provided with openings or holes for the discharge of water. Freshly dredged sand or gravel is thus allowed to drip during the travel.

Like the towboat, the barge is designed to receive, despite a depth of immersion of only 90 cm, a cargo of nearly 700 tons, so that the integrated tow is suitable for operation in extremely low water. Based on feasible sizes and dimensions, the barge could hold a cargo of 1,250 tons. To this end, the assembly as a whole could have a total length of 110 m, so as to permit navigation on the Elbe River under there existing circumstances. Accordingly, the towboat could measure about 18.5 m long and the barge 91.5 m. Also, it is preferable that the width of the assembly not exceed 11.4 m. This would ensure the navigability of the Elbe River and the waterways of the Brandenburg March. Finally, the assembly should be dimensioned for a smallest possible clearance of maximally 3.0 m, so as to permit also in this respect the aforesaid inland waterway navigation with respect to existing bridges.

BRIEF DESCRIPTION OF THE DRAWINGS

There exist various possibilities of improving and further developing the teaching of the present invention. To this end, reference may be made, to the following description of an embodiment of the invention with reference to the drawings, in which.

DETAILED DESCRIPTION OF THE PREFERRED EMBODIMENT

Shown in FIGS. 1–8 are the essential parts of an embodiment of a cargo transport assembly in accordance with the invention, namely, a towboat 1 and a barge 2 which is pushed and steered by the towboat. In accordance with the invention, the towboat is propelled by a paddle wheel 3 arranged at its stern.

Figure 2:
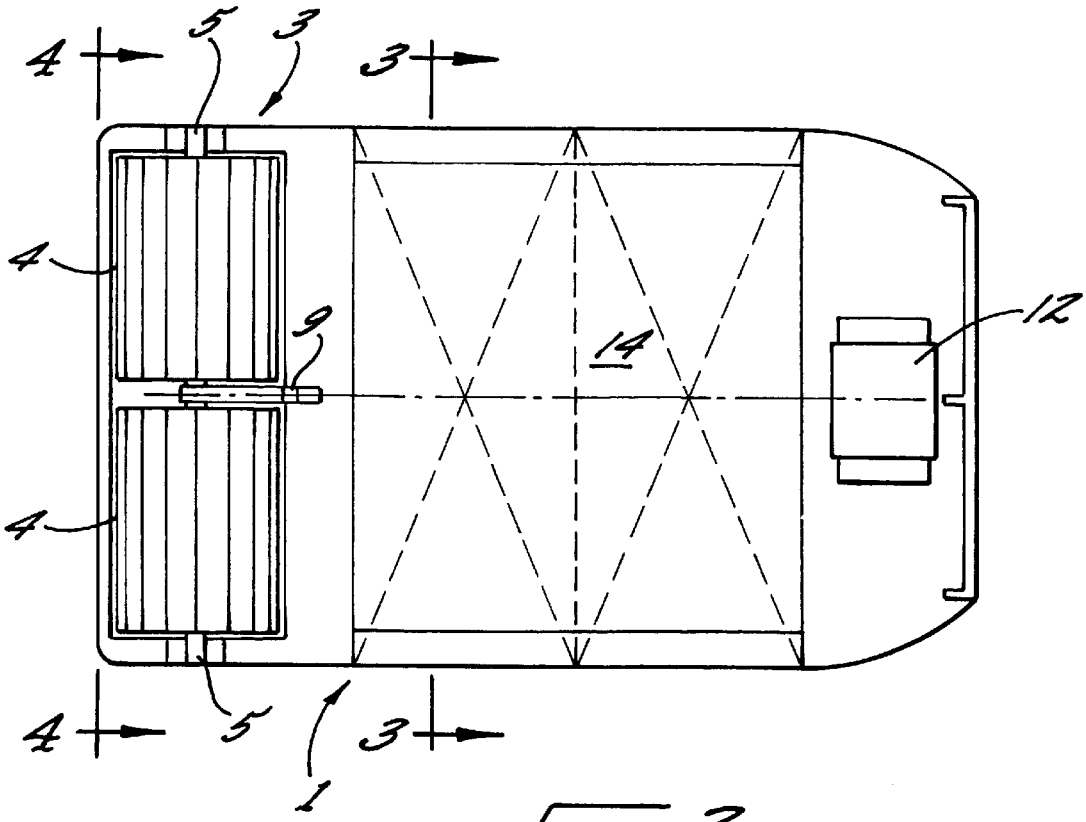
FIG. 2 is a schematic top view of the subject matter of FIG. 1.
Figure 4:
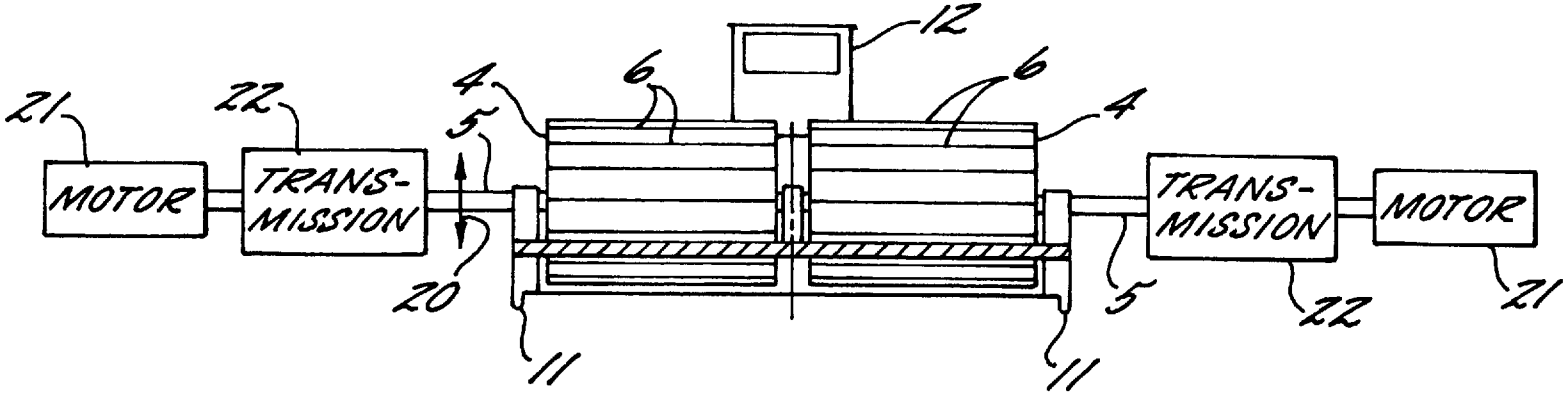
FIG. 4 is a sectional view of the subject matter of FIG. 2 along line B—B.

In the illustration selected in FIGS. 2 and 4, the towboat drive includes two paddle wheels 4 mounted on two axially aligned driving shafts 5. The driving shafts 5 may be vertically adjustable as schematically indicated by the arrow 20 in FIG. 4. The paddle wheels may be driven separately, i.e. each individually via its respective motor 21. A hydraulic power transmission 22 ensures an extremely low weight of this operative connection and, thus, a small overall length of the towboat. This in turn provides the greatest possible overall length of the barge as well as the smallest possible draft of the assembly as a whole with a relatively high cargo weight.

As can further be noted from FIGS. 2 and 4, the two paddle wheels 4 occupy together nearly the entire width of the towboat. To this end, their paddles 6 may have a maximum surface relative to the drive and, incidentally, they are made of aluminum.

As is further shown in FIGS. 1–4, the hull 7 of towboat 1 is constructed as a pontoon. As a result of this construction the towboat or its hull are designed such that it does not exceed with any structural part a maximum depth of immersion of about 90 centimeters.

Figure 1:
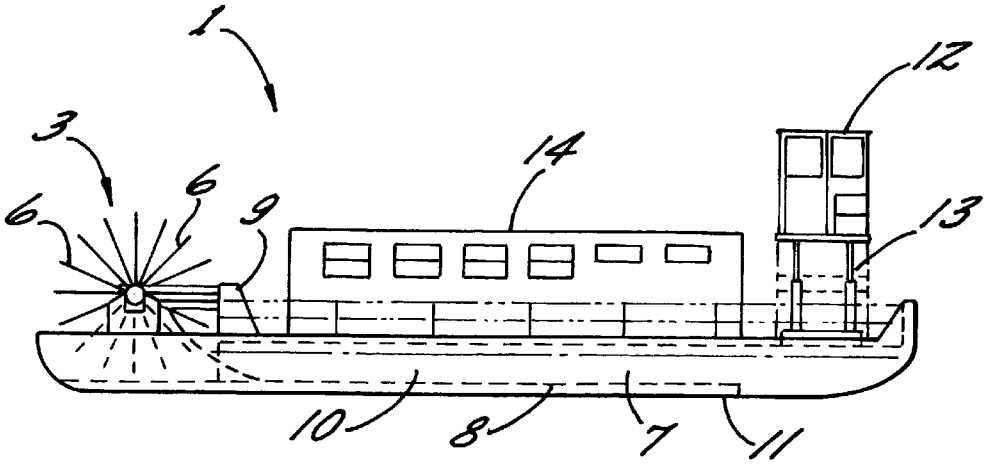
FIG. 1 is a schematic side view of a towboat serving as a drive unit of a cargo transporting assembly in accordance with the invention.
Figure 3:
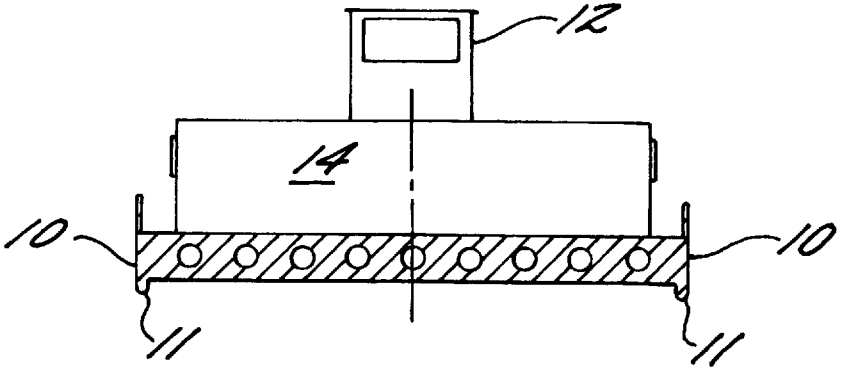
FIG. 3 is a sectional view of the subject matter of FIG. 2 along line A—A.

As can further be noted from outlines in FIGS. 1, 3, and 4, the hull 7 is provided, on both sides as a projection of its side walls 10, with keels 11 extending downward over a length of about 25 centimeters. These keels per se ensure a stabilized straight-on travel. As is further shown in FIGS. 1 and 4, the hull 7 is closed in the region of paddle wheels 4.

As only sketchily indicated in FIG. 1, the ship bottom 8 of the towboat slopes toward the paddle wheels 4 at an angle of less than 30°. In the region of the upwardly sloping bottom 8, a rudder may be provided, which ensures a stabilized straight-on travel with a small depth of immersion. This rudder could also be arranged in the region below a bearing 9 in the center of driving shafts 5.

Above the pontoon, i.e. mounted on hull 7 is vertically adjustable pilot bridge 12. The pilot bridge 12 is arranged on a lifting mechanism 13 constructed in the fashion of a scissor-type folding table, which is actuatable via cylinder-piston arrangements. Also essential for pilot bridge 12 is that it be arranged at the forward end of hull 7.

Finally, the hull 7 of towboat 1 is provided with a superstructure 14 for use as living quarters and engine room. This superstructure 14 is located substantially in the center of the hull 7.

Figure 5:
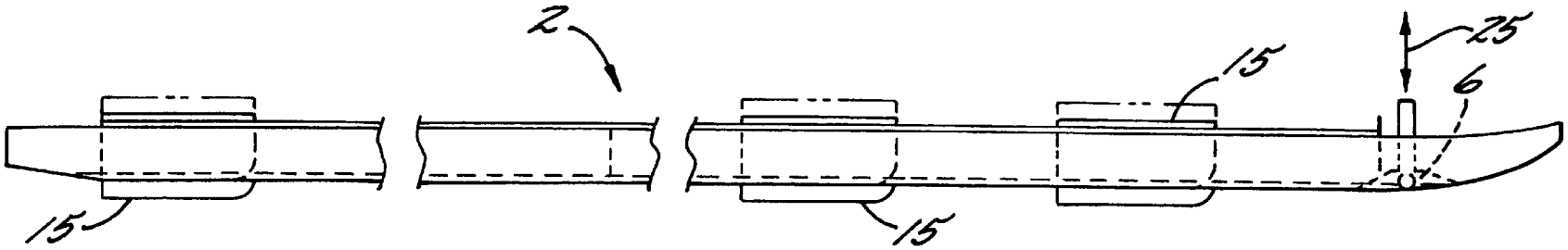
FIG. 5 is a partial schematic side view of a barge of the assembly in accordance with the invention.
Figure 6:
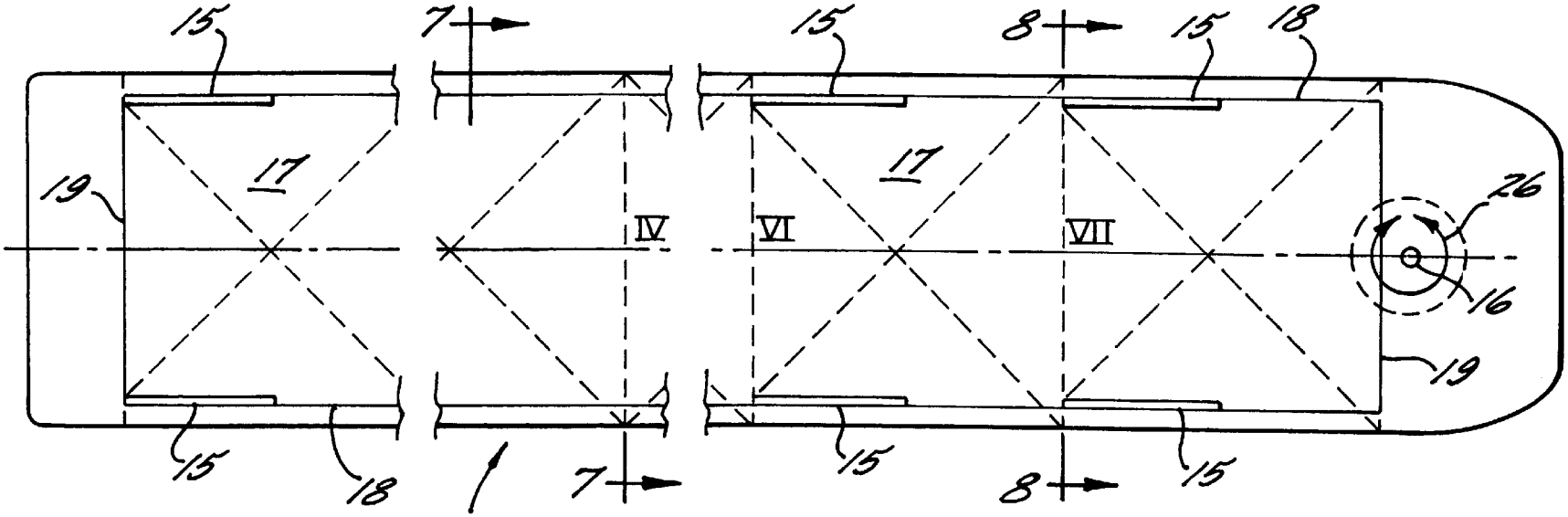
FIG. 6 is a schematic top view of the subject matter of FIG. 5.
Figure 7:
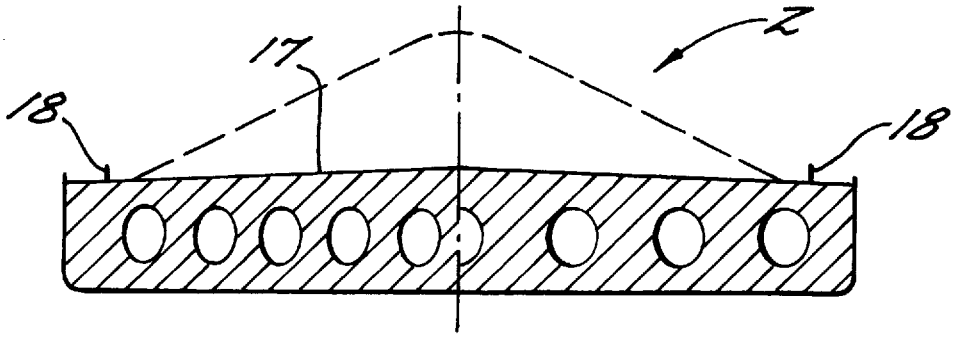
FIG. 7 is a sectional view of the subject matter of FIG. 6 along line B—B.
Figure 8:
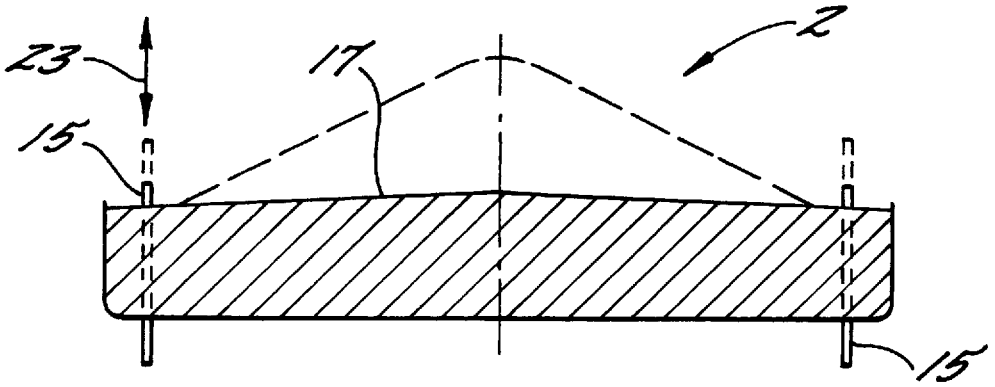
FIG. 8 is a sectional view of the subject matter of FIG. 6 along line A—A.

FIGS. 5–8 are different views of a barge 2 of the assembly and in accordance with the invention. In the same manner as the hull 7 of towboat 1, the barge 2 is constructed as a pontoon. As shown in FIGS. 5, 6, and 8, two pairs of lateral skegs 15 are provided in the forward region and one pair of skegs 15 in the rearward region. These pairs of skegs 15 are intended to counteract a drifting of the assembly. The skegs 15 can be lowered and raised, or they may be tiltable, as illustrated by the dashed line positions and by the arrow 23 in FIG. 8.

Figure 9:
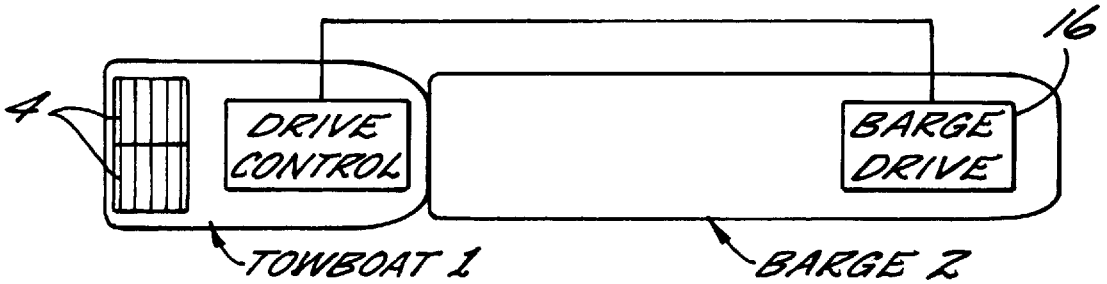
FIG. 9 is a schematic view of the towboat and barge of the present invention, shown operatively coupled to each other.

As is further indicated by outlines in FIGS. 5 and 6, the bow of the barge 2 accommodates a drive 16 which is controllable from the towboat 1, as schematically illustrated in FIG. 9. This drive may be vertically adjustable and, in addition, rotatable by 360°. The vertical adjustability is illustrated by the arrow 25 in FIG. 5, and the rotational adjustability is illustrated by the arrow 26 in FIG. 6. In the illustrated embodiment, the drive is constructed as a Schottel pump jet drive.

As shown in FIGS. 6, 7, and 8, the loading surface 17 of the barge 2 has the profile of a saddle roof with a transverse inclination of about 2°. Further provided is a peripheral boundary 18 of the loading surface, which measures on each side about 0.3 m high. Each end side is provided with a boundary wall 19 measuring 0.7 m high, which serves to countermove the cargo.

As regards the maximally acceptable depth of immersion, a maximum load capacity, maximum dimensions and other details not shown in the Figures, and for purposes of avoiding repetitions, the description of the background of the invention is herewith incorporated by reference.

Finally, it should be explicitly noted that the above-described embodiment relates merely to the claimed teaching without being limited thereto.

I claim:

1. A cargo transport assembly for transporting cargo on a shallow waterway, and comprising a towboat including a paddle wheel drive, and at least one barge operatively connected to the towboat, said one barge including a barge drive, with said barge drive being vertically adjustable and rotatable by 360°, and said barge further including at least one vertically adjustable skew, and a drive control located on the towboat for controlling said barge drive.

2. The cargo transport assembly as defined in claim 1 wherein the barge includes a bow end and a stern end, and wherein the barge drive is located adjacent the bow end thereof.

3. The cargo transport assembly as defined in claim 2 wherein said barge drive comprises a pump jet.

4. The cargo transport assembly as defined in claim 1 wherein said paddle wheel drive of said towboat comprises two paddle wheels respectively arranged on two coaxial drive shafts.

5. The cargo transport assembly as defined in claim 4 wherein said paddle wheel drive of said towboat further comprises power means for selectively driving the two paddle wheels at the same rotational speed or at different rotational speeds.

6. The cargo transport assembly as defined in claim 5 wherein said power means further includes provision for selectively driving the two paddle wheels in opposite directions.

7. The cargo transport assembly as defined in claim 6 wherein said power means of said towboat comprises two separately controllable motors.

8. The cargo transport assembly as defined in claim 7 wherein said paddle wheel drive of said towboat further comprises a hydraulic transmission between said motors and said paddle wheels.

9. The cargo transport assembly as defined in claim 4 wherein the towboat has a width dimension, and wherein the two paddle wheels collectively have a length which comprises substantially the entire width dimension of the towboat.

10. The cargo transport assembly as defined in claim 1 wherein said paddle wheel drive comprises at least one paddle wheel, and means mounting said one paddle wheel for vertical adjustment.

11. The cargo transport assembly as defined in claim 1 wherein said towboat includes a relatively flat bottom.

12. The cargo transport assembly as defined in claim 1 wherein said towboat further comprises at least one keel adjacent each side thereof.

13. The cargo transport assembly as defined in claim 1 wherein said towboat further includes a vertically adjustable pilot bridge, and a superstructure which is sized for use as living quarters.

14. The cargo transport assembly as defined in claim 1 wherein the tugboat is constructed as a pontoon.

15. The cargo transport assembly as defined in claim 1 wherein said barge is constructed as a pontoon.

16. The cargo transport assembly as defined in claim 1 wherein the barge includes a loading surface which has the profile of a saddle roof with a transverse inclination of about 2°.

17. A cargo transport assembly for transporting cargo on a shallow waterway, and comprising a towboat including a paddle wheel drive, at least one barge operatively connected to the towboat, said one barge including a barge drive, a bow end region and a stern end region, and wherein said barge drive is rotatable by 360°, a drive control located on the towboat for controlling the direction of said barge drive, and at least one pair of lateral skegs mounted in said bow and region, and at least one pair of lateral skegs mounted in said stern end region, with at least one of said pairs of lateral skegs being vertically adjustable to vary the depth of penetration thereof into the waterway.

18. The cargo transport assembly as defined in claim 17 wherein at least two pairs of lateral skegs are mounted in said bow end region of said one barge.

19. The cargo transport assembly as defined in claim 17 wherein at least one of said pairs of lateral skegs is tiltable.

* * * * *